US012779287B2

(12) United States Patent
Stephen et al.

(10) Patent No.: US 12,779,287 B2
(45) Date of Patent: Nov. 3, 2026

(54) EXERCISE COACHING SYSTEM AND METHOD OF USING

(71) Applicant: NEC Corporation, Tokyo (JP)

(72) Inventors: Karen Stephen, Tokyo (JP); Yuki Kosaka, Tokyo (JP)

(73) Assignee: NEC Corporation, Tokyo (JP)

( * ) Notice: Subject to any disclaimer, the term of this patent is extended or adjusted under 35 U.S.C. 154(b) by 190 days.

(21) Appl. No.: 18/749,619

(22) Filed: Jun. 21, 2024

(65) Prior Publication Data

US 2025/0387670 A1 Dec. 25, 2025

(51) Int. Cl.
*A63B 24/00* (2006.01)

(52) U.S. Cl.
CPC .. *A63B 24/0075* (2013.01); *A63B 2024/0009* (2013.01)

(58) Field of Classification Search
CPC ..... A63B 24/0075; A63B 2024/0009
USPC ..... 434/257
See application file for complete search history.

(56) References Cited

U.S. PATENT DOCUMENTS

| | | | | |
|---|---|---|---|---|
| 2016/0300347 | A1 | 10/2016 | Dunn et al. | |
| 2018/0317813 | A1* | 11/2018 | Hall | A63B 21/4037 |
| 2018/0325472 | A1* | 11/2018 | Lin | A61B 6/545 |
| 2020/0197746 | A1 | 6/2020 | Kang | |
| 2024/0198177 | A1* | 6/2024 | Kruger | G09B 19/0038 |
| 2024/0382806 | A1* | 11/2024 | Omid-Zohoor | A61B 5/6895 |
| 2026/0038665 | A1* | 2/2026 | Aragones | G16H 20/30 |

FOREIGN PATENT DOCUMENTS

| | | | |
|---|---|---|---|
| WO | 00/17767 | A1 | 3/2000 |
| WO | 2008/099301 | A1 | 8/2008 |
| WO | 2021/014149 | A1 | 1/2021 |

OTHER PUBLICATIONS

Fieraru et al., "AIFit: Automatic 3D Human-Interpretable Feedback Models for Fitness Training", Proceedings of the IEEE/CVF Conference on Computer Vision and Pattern Recognition (CVPR), 2021, pp. 9919-9928, 10pp.

Zhao et al., "3D Pose Based Feedback for Physical Exercises", Proceedings of the Asian Conference on Computer Vision, Aug. 5, 2022, 20pp.

* cited by examiner

*Primary Examiner* — Dmitry Suhol
*Assistant Examiner* — Alyssa N Biancamano
(74) *Attorney, Agent, or Firm* — HAUPTMAN HAM, LLP

(57) ABSTRACT

A system for exercise coaching includes a non-transitory computer readable medium configured for storing. The system further includes a processor connected to the non-transitory computer readable medium. The processor is configured to execute the instructions for receiving input data from a user, wherein the input data includes a plurality of images of the user performing an exercise; and extracting pose data from the input data. The processor is configured to execute the instructions for determining whether a difference between the extract pose data and a reference is less than a predetermined threshold value; and determining muscle stretch information, in response to the difference being less than the predetermined threshold value, from the input data. The processor is configured to execute the instructions for determining feedback to the user for increasing a degree of muscle stretch during a subsequent performance of the exercise relative to the determined muscle stretch information.

20 Claims, 6 Drawing Sheets

EXERCISE COACHING SYSTEM AND METHOD OF USING

BACKGROUND

Access to physical therapy is difficult for numerous reasons. In an effort to provide remote services to assist in physical therapy, some approaches utilize video to assist a user to perform exercises. In some approaches, the user records a video of the exercises performed by the user and uploads the videos for review by a professional. The user is able to receive feedback regarding positioning of parts of the body to determine whether a pose executed by the user is proper. In some instances, the feedback includes text or visual depictions for how to adjust the pose.

SUMMARY

An aspect of this description relates to a system for providing exercise coaching. The system includes a non-transitory computer readable medium configured to store instructions thereon. The system further includes a processor connected to the non-transitory computer readable medium. The processor is configured to execute the instructions for receiving input data from a user, wherein the input data comprises a plurality of images of the user performing an exercise. The processor is configured to execute the instructions for extracting pose data from the input data. The processor is configured to execute the instructions for determining whether a difference between the extract pose data and a reference is less than a predetermined threshold value. The processor is configured to execute the instructions for determining muscle stretch information, in response to the difference being less than the predetermined threshold value, from the input data. The processor is configured to execute the instructions for determining feedback to provide to the user for increasing a degree of muscle stretch during a subsequent performance of the exercise relative to the determined muscle stretch information.

An aspect of this description relates to a method of providing exercise coaching. The method includes receiving input data from a user, wherein the input data comprises a plurality of images of the user performing an exercise. The method includes extracting pose data from the input data. The method includes determining whether a difference between the extract pose data and a reference is less than a predetermined threshold value. The method includes determining muscle stretch information, in response to the difference being less than the predetermined threshold value, from the input data. The method includes determining feedback to provide to the user for increasing a degree of muscle stretch during a subsequent performance of the exercise relative to the determined muscle stretch information.

An aspect of this description relates to a non-transitory computer readable medium configured to store instructions for providing exercise coaching. The instructions are configured to cause a processor to perform operations comprising receiving input data from a user, wherein the input data comprises a plurality of images of the user performing an exercise. The instructions are configured to cause a processor to perform operations comprising extracting pose data from the input data. The instructions are configured to cause a processor to perform operations comprising determining whether a difference between the extract pose data and a reference is less than a predetermined threshold value. The instructions are configured to cause a processor to perform operations comprising determining muscle stretch information, in response to the difference being less than the predetermined threshold value, from the input data. The instructions are configured to cause a processor to perform operations comprising determining feedback to provide to the user for increasing a degree of muscle stretch during a subsequent performance of the exercise relative to the determined muscle stretch information.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
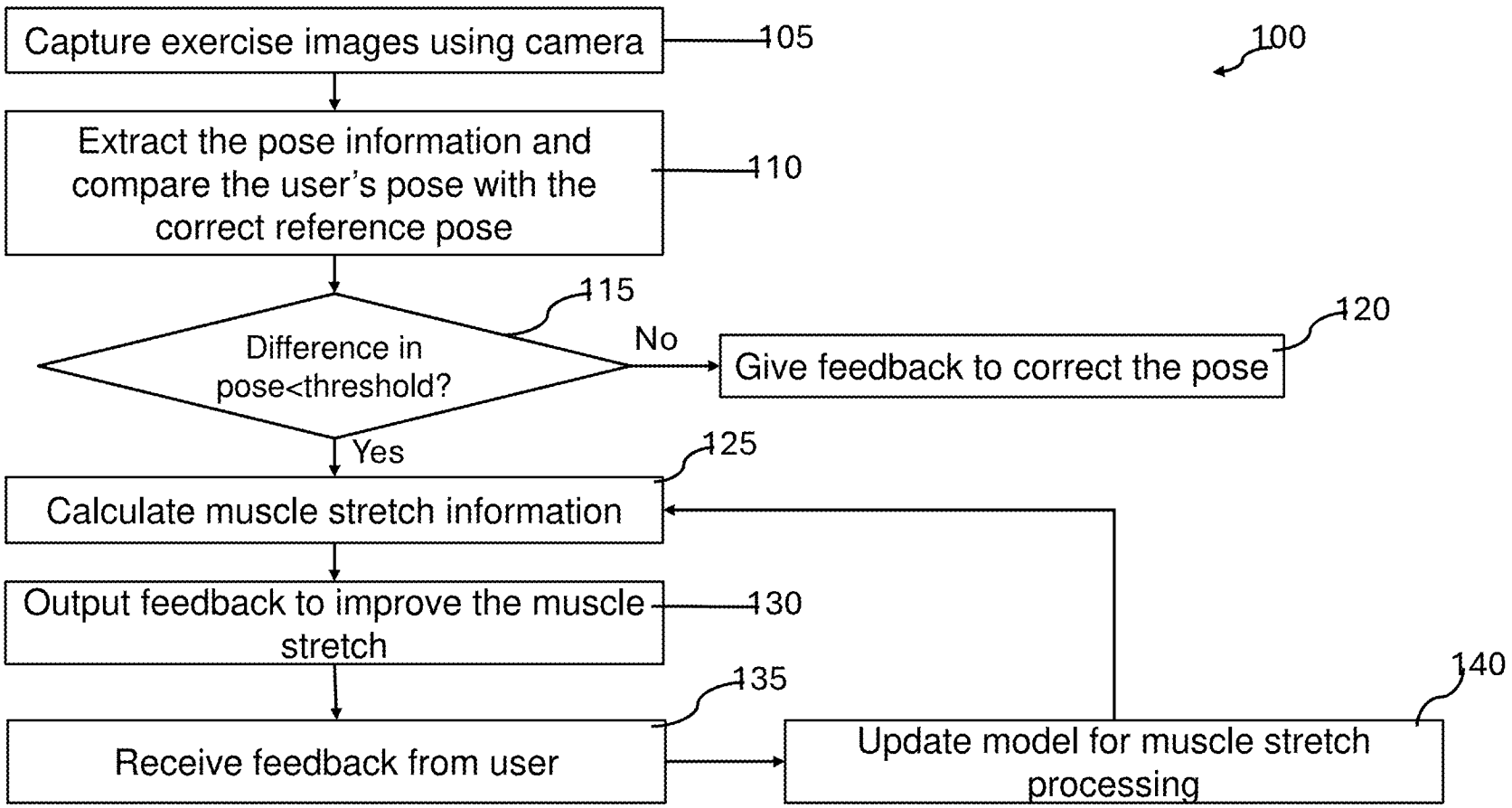
FIG. 1 is a flowchart of a method of providing exercise coaching, in accordance with some embodiments.

The following disclosure provides many different embodiments, or examples, for implementing different features of the provided subject matter. Specific examples of components, values, operations, materials, arrangements, or the like, are described below to simplify the present disclosure. These are, of course, merely examples and are not intended to be limiting. Other components, values, operations, materials, arrangements, or the like, are contemplated. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Available physical therapists are becoming more difficult to find. As a result, obtaining physical therapy (PT) is becoming increasingly difficult for many people. In order to assist people in obtaining PT, some approaches are utilizing at-home exercises in order improve body functions. In some approaches, a camera is utilized to capture a video of a person doing an exercise and the video is analyzed to determine whether the positioning of the body parts of the person is proper during the exercise. While this type of approach is helpful, monitoring only the positioning of body parts of the person, also called a pose, fails to fully account for whether muscles are being stretched as intended. That is, a person is capable of moving body parts in the proper manner without stretching the correct muscles or without stretching the correct muscles to the proper degree.

In order to help account for stretching of muscles, the current description includes an exercise coaching system and method of using the monitors both pose and muscle stretching in order to help improve the results of a person doing PT. The system helps to support a patient's decision making for moving body parts in a proper manner to obtain a target amount of muscle stretching. The system receives video of the person performing an exercise and analyzes the video to determine both pose and muscle stretch data and provides advice or corrections to improve the performance of the person doing the exercise. In some embodiments, the system receives additional information such as input from the user following the exercise, visual input from multiple angles, sensors on a surface of the body, neural network (NN) analysis of the body, or other suitable information. Using this additional information in combination with the video input, the system is able to determine whether the exercise is being performed correctly.

In some embodiments, the system further includes a trained NN usable to analyze the movements of the person doing the exercise. The trained NN is able to plot an analysis of the movements in a solution space. The trained NN is then able to select feedback to improve the exercise based on determined muscle stretch information and a target muscle stretch degree. In some embodiments, the NN is re-trained using the analysis of the movements. The system is capable of providing the feedback from a live trainer or automatic feedback, such as text, text to talk, recommended videos, or other suitable automatic feedback.

The system helps to improve analysis of exercises performed by a person by analyzing both pose and muscle stretch information. Analyzing both types of information improves an ability of the system to provide relevant feedback to the person in order to increase a benefit of the PT to the person. The system also helps to reduce demand on live trainers by providing automated feedback, which allows the person to undergo PT without having to wait for an appointment. In some instances, the person is unable to easily exit their home and travel to an office for PT. This system helps to enable the person to undergo PT within the home or another convenient location without having to travel to an office.

Figure 3:
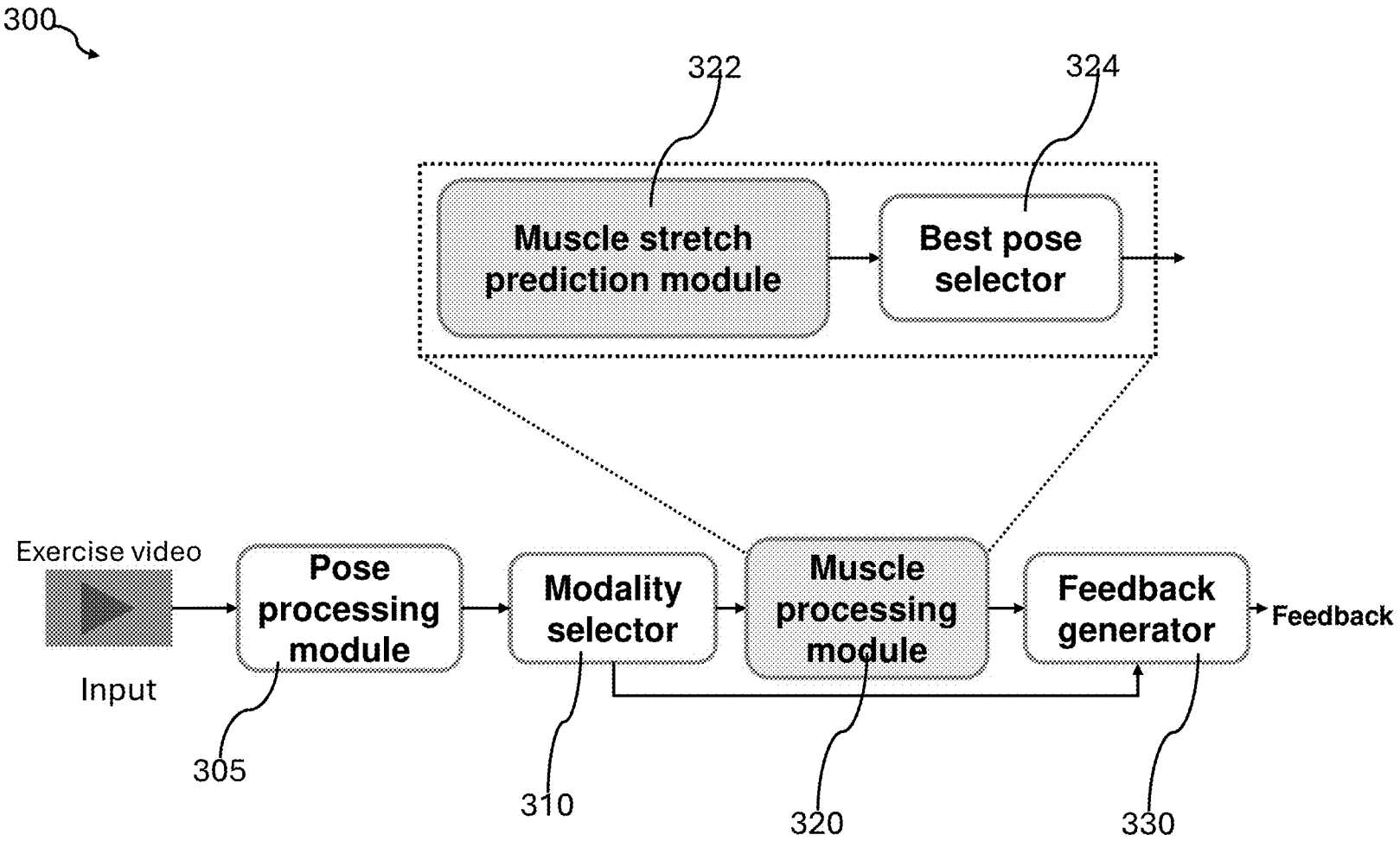
FIG. 3 is a schematic diagram of a system for providing exercise coaching, in accordance with some embodiments.
Figure 4:
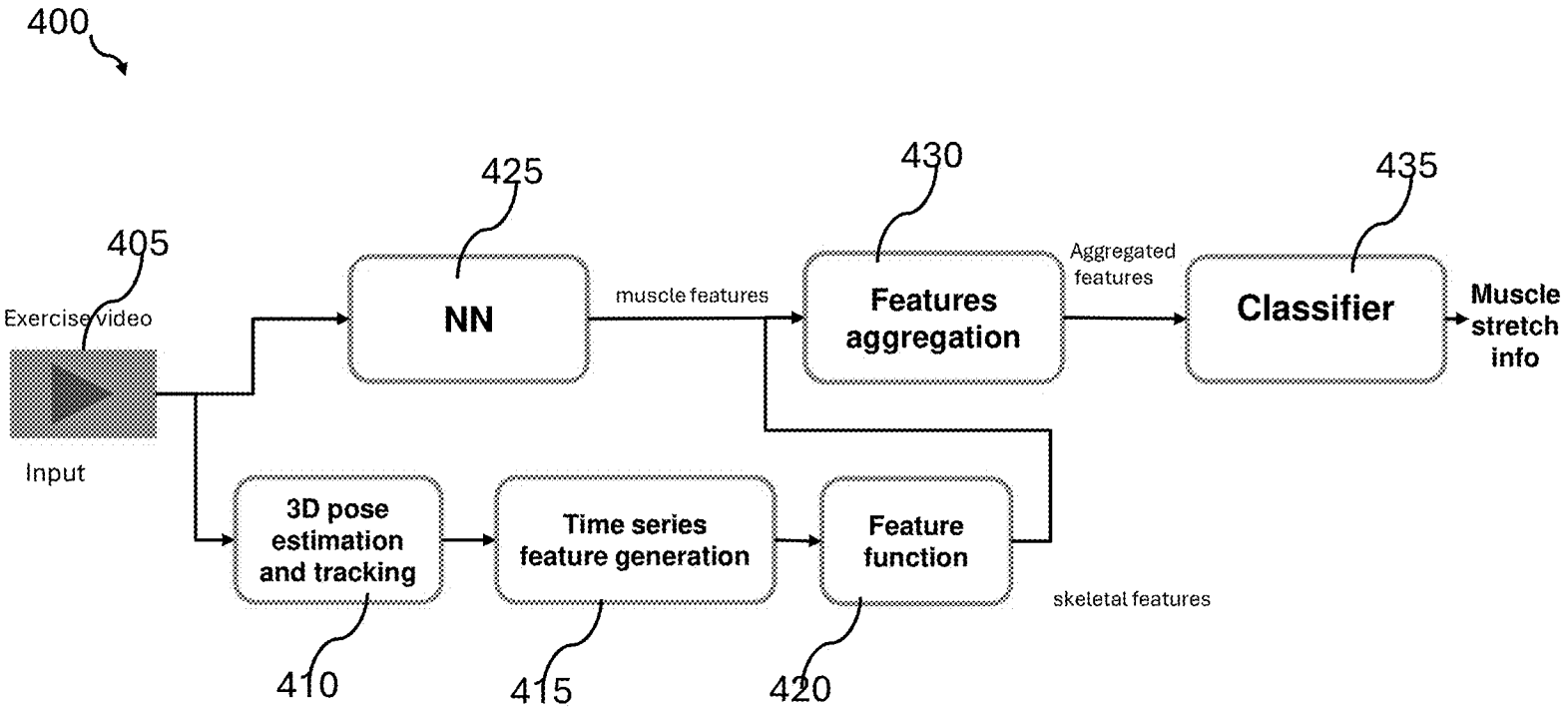
FIG. 4 is a flowchart of a method of muscle stretch prediction for determining muscle stretch information, in accordance with some embodiments.
Figure 5:
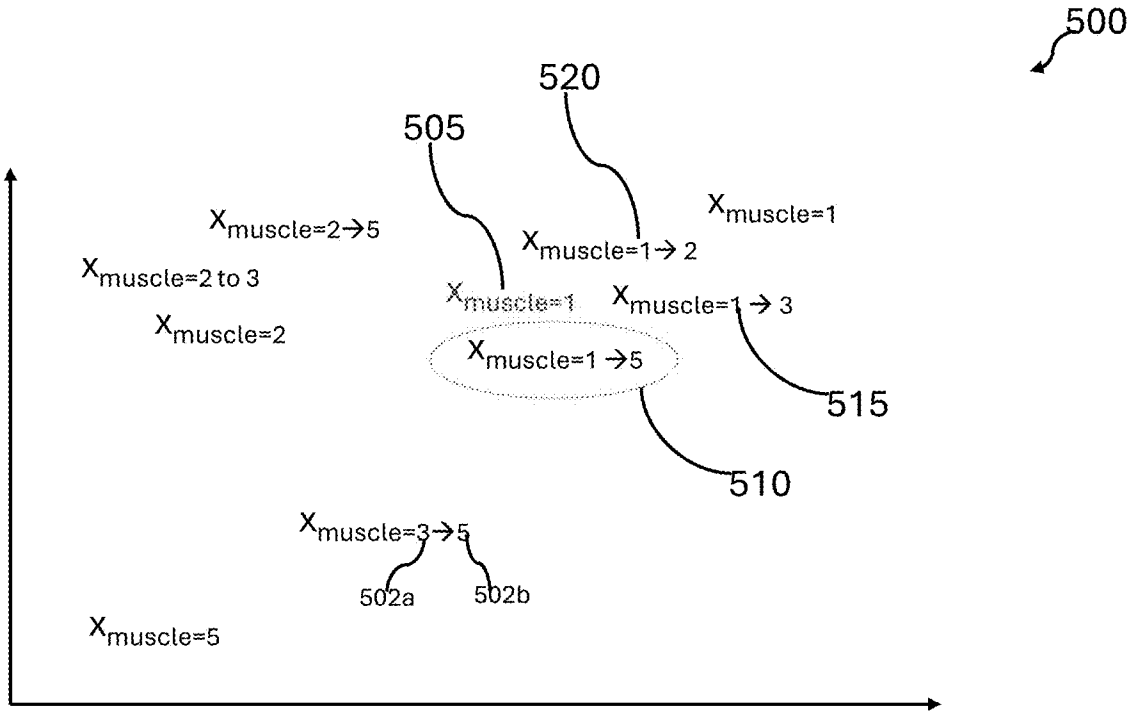
FIG. 5 is a view of a solution space for providing exercise coaching recommendations, in accordance with some embodiments.
Figure 6:
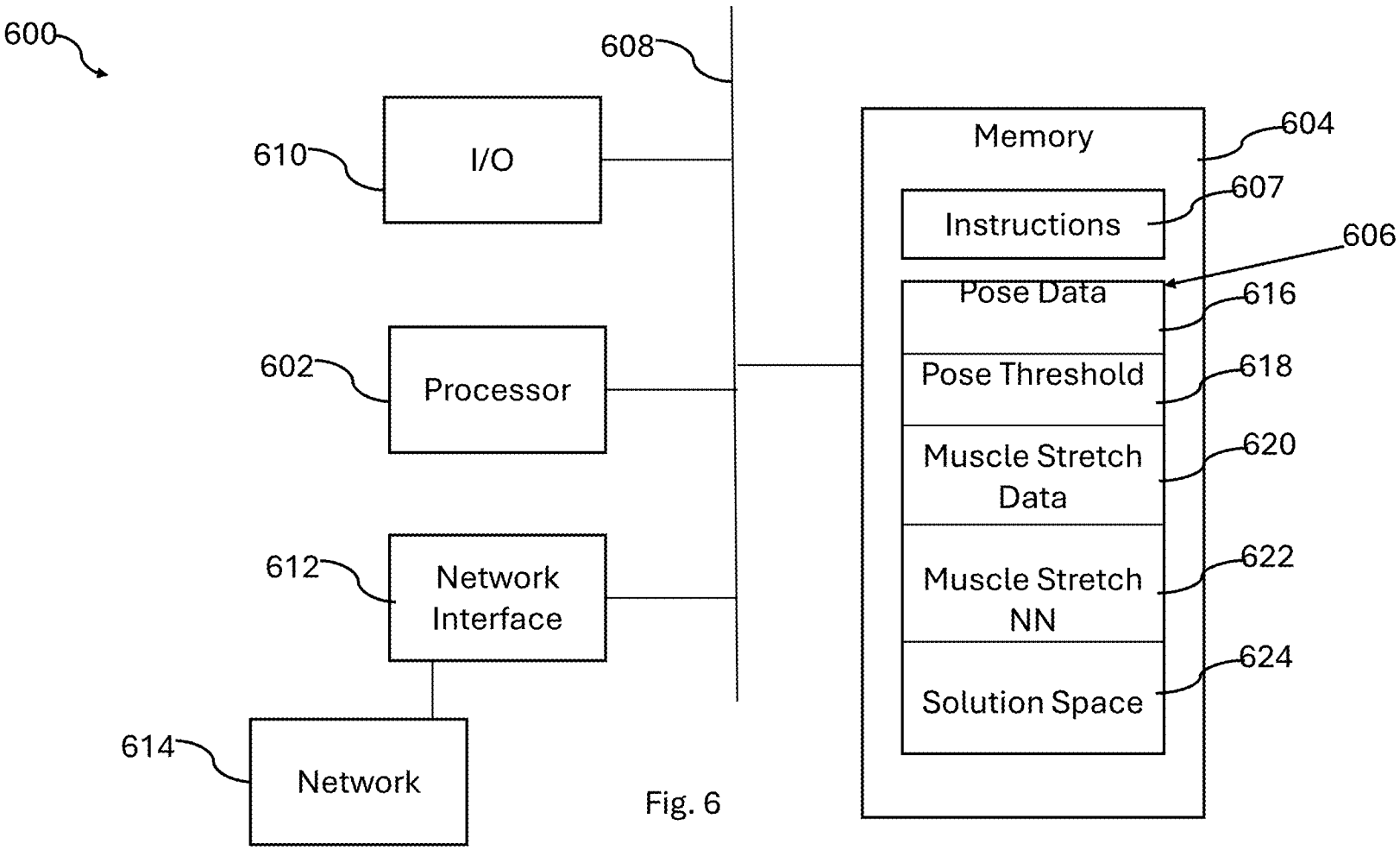
FIG. 6 is a diagram of a system for exercise coaching, in accordance with some embodiments.

FIG. 1 is a flowchart of a method 100 of providing exercise coaching, in accordance with some embodiments. The method 100 is executed to provide exercise coaching to a person doing an exercise, also called a patient. In some embodiments, the method 100 is executed using a system 600 (FIG. 6). In some embodiments, the method 100 is executed by a system other than the system 600 (FIG. 6). In some embodiments, the method 100 is executed using a user interface (UI), such as UI 200 (FIG. 2) or another suitable UI. In some embodiments, the method 100 is implemented in using a system 300 (FIG. 3). In some embodiments, the method 100 is implemented using a trained NN, e.g., using the method 400 (FIG. 4). In some embodiments, the method 100 is implemented using selection of feedback using a solution space, e.g., solution space 500 (FIG. 5). One of ordinary skill in the art would recognize that the following description of the method 100 is capable of modification within the scope of this application.

In operation 105, images of an exercise are captured using a camera. The images are of the patient performing the exercise. In some embodiments, the images are part of a video. In some embodiments, the images are captured using a single camera. In some embodiments, the images are captured using multiple cameras. In some embodiments, the camera includes a visible light camera. In some embodiments, the camera includes a structure light sensor (SLS) camera. In some embodiments, the camera includes an infrared (IR) camera. In some embodiments that include multiple cameras, different types of cameras are used to capture the images. In some embodiments that include multiple cameras, each of the cameras is a same type.

In some embodiments, the camera is part of a device that includes a transmitter, such as a smartphone, a tablet, or a computer. In some embodiments, the camera is a stand-alone device that is incapable of transmitting wirelessly.

In some embodiments, the images are transmitted to a server, which is remote from the camera. In some embodiments, the images are transmitted wirelessly. In some embodiments, the images are transmitted via a wired connection. In some embodiments, the images are transferred from the camera to an intermediate device for transferring to the server. In some embodiments, the images are input into an application or software program, such as an application on a smartphone or tablet; or a computer program executed on a program. In some embodiments, the images are captured using the application or software program.

In operation 110, pose information is extracted from the images and the user's pose is compared with a reference pose. The pose information indicates movement of parts of the user's, i.e., the patient's, body. The pose information is extracted from the images captured in the operation 105. In some embodiments, the images are processed to allow extraction of pose information. For example, in some embodiments, the images are processed to reduce the body of the patient to a skeletal frame.

The pose information tracks movements of the patient's body while performing an exercise. In some embodiments, the pose information relates to movements of the patient's body through at least one complete cycle of the exercise. In some embodiments, the pose information relates to a posture of the patient's body in one or more frames during performance of the exercise. In some embodiments, the one or more frames are selected based on postures of the patient's body identified as primary postures for stretching target muscles of the patient's body. In some embodiments, the pose information tracks movement of the patient's body through multiple cycles of the exercise. In some embodiments that track pose information through multiple cycles, an average of the pose information is utilized for later analysis. In some embodiments that track pose information through multiple cycles, a mode of the pose information is utilized for later analysis. One of ordinary skill in the art would recognize that other criteria, such as standard deviation, are also usable for analyzing pose information across multiple cycles.

In operation 115, the pose information is compared with reference images to determine whether a difference between the pose information and the reference images is below a predetermine threshold value. The reference images are images indicating a proper or correct movement of the body when performing the same exercise performed by the patient. In some embodiments, the references images are of a person. In some embodiments, the reference images are computer generated. In some embodiments, the reference images include skeletal images.

The threshold value indicates an acceptable difference between the pose information and the reference images to achieve the PT goals of the patient. The threshold value ranges from greater than 0, which indicates an exact match with the reference images, to less than 1, which indicates completely dissimilar to the reference images. The threshold value is based on the exercise being performed. The threshold value is further based on patient information. In some embodiments, the patient information includes patient age, patient experience with the exercise, previous patient performance, or other suitable patient information. For example, in some embodiments, the patient is relatively new to PT and has limited experience performing the exercise. In order to account for a potential reduced flexibility on the part of the patient, the threshold value is reduced for the patient that is new to PT. In some embodiments, the threshold value is set by a trainer prior to the patient beginning the exercise. In some embodiments, the threshold value is set automatically based on the exercise and the patient information. In some embodiments, the threshold value changes for a patient as the patient's experience or flexibility increases for future PT sessions. In some embodiments, the threshold value is set using a trained NN usable for determining how other patients having similar patient information as the current patient perform the current exercise.

In response to a determination that the difference between the pose information and the reference images is equal to or greater than the threshold value, the method 100 proceeds to operation 120. In response to a determination that the difference between the pose information and the reference images is less than the threshold value, the method 100 proceeds to operation 125.

In operation 120, feedback is given to the patient for correcting the pose of the patient. In some embodiments, the feedback includes a sample video, such as the reference images. In some embodiments, the feedback includes a diagram, such as a series of still diagrams or a moving image diagram. In some embodiments, the feedback includes text. In some embodiments, the feedback includes audio. One of ordinary skill in the art would understand that combinations of types of feedback discussed above or other suitable types of feedback are within the scope of this description.

In some embodiments, the feedback is provided using a UI, such as the UI 200 (FIG. 2), or another suitable UI. In some embodiments, the feedback is selected automatically by an application or computer program. In some embodiments, the feedback is selected automatically based on a trained NN. In some embodiments, the feedback is selected automatically based on a solution space, such as solution space 500 (FIG. 5). In some embodiments, the feedback is selected by a trainer.

In some embodiments, the feedback is displayed automatically to the patient. In some embodiments, an alert is generated when feedback is available. In some embodiments, the alert includes an audio or visual alert. In some embodiments, the remote server is configured to transmit the feedback to a device, such as a smartphone, tablet or computer, accessible by the patient. In some embodiments, the alert includes instructions for causing the device to automatically display the alert.

In operation 125, muscle stretch information is calculated. In some embodiments, the muscle stretch information is calculated based on the images captured in the operation 105. In some embodiments, the muscle stretch information is calculated based on images from multiple cameras. In some embodiments, the muscle stretch information is calculated based on a trained NN, e.g., a NN trained using the method 400 (FIG. 4). In some embodiments, the muscle stretch information is determined based on changes in shape of the body of the patient as the body parts of the patient move during the exercise.

In some embodiments, the muscle stretch information is obtained from a source other than the images received in operation 105. In some embodiments, the muscle stretch information is received by an input from the patient. In some embodiments, the input is received from the patient using text. In some embodiments, the input is received from the patient using detection of the patient's voice. In some embodiments, the input is received from the patient through a UI, such as the UI 200 (FIG. 2), or another suitable UI. In some embodiments, the muscle stretch information is received from one or more sensors attached to the body of the patient during the exercise.

In operation 130, feedback is provided to the patient for improving the muscle stretch of the patient. In some embodiments, the feedback includes a sample video, such as the reference images. In some embodiments, the feedback includes a diagram, such as a series of still diagrams or a moving image diagram. In some embodiments, the feedback includes text. In some embodiments, the feedback includes audio. One of ordinary skill in the art would understand that combinations of types of feedback discussed above or other suitable types of feedback are within the scope of this description.

In some embodiments, the feedback is provided using a UI, such as the UI 200 (FIG. 2), or another suitable UI. In some embodiments, the feedback is selected automatically by an application or computer program. In some embodiments, the feedback is selected automatically based on a trained NN, e.g., a NN trained using the method 400 (FIG. 4). In some embodiments, the feedback is selected automatically based on a solution space, such as solution space 500 (FIG. 5). In some embodiments, the feedback is selected by a trainer.

In some embodiments, the feedback is displayed automatically to the patient. In some embodiments, an alert is generated when feedback is available. In some embodiments, the alert includes an audio or visual alert. In some embodiments, the remote server is configured to transmit the feedback to a device, such as a smartphone, tablet or computer, accessible by the patient. In some embodiments, the alert includes instructions for causing the device to automatically display the alert.

In some embodiments, the feedback is selected based on the patient information. For example, in some embodiments where a patient has recently begun PT, over stretching of the muscle is not intended. As a result, in some embodiments, the feedback is selected to adjust the muscle stretch of the patient from the calculated value to a target value where the target value is less than a maximum stretch of the muscle. Additional description associated with selecting feedback for a target value of muscle stretch is provided below with respect to the solution space 500 (FIG. 5).

In operation 135, feedback is received from the user. The patient provides feedback to the trainer, the application, or computer program related to how the patient feels following the exercise. In some embodiments, the patient provides feedback indicating an amount of stretching that the patient felt while performing the exercise. For example, in some embodiments, the patient is requested to enter a value from 1 to 5 indicating an amount of stretching that the patient felt in a specific muscle while performing the exercise. In some embodiments, the patient provides feedback related to the feedback on the muscle stretch received in operation 130. In some embodiments, the input is received from the patient using text. In some embodiments, the input is received from the patient using detection of the patient's voice. In some embodiments, the input is received from the patient through a UI, such as the UI 200 (FIG. 2), or another suitable UI.

In some embodiments, the feedback received in operation 135 causes an alert to be displayed automatically on a device, such as a smartphone, tablet or computer, accessible by the trainer. In some embodiments, the alert is generated when patient feedback is available. In some embodiments, the alert includes an audio or visual alert. In some embodiments, the alert includes instructions for causing the device to automatically display the alert.

In operation 140, a model used for calculating the muscle stretch information is updated based on the feedback from the patient. The model is used to help enhance the feedback provided to the patient during future PT sessions. For example, in some embodiments, the patient inputs feedback indicating a high amount of muscle stretching; however, the calculated muscle stretch information in operation 125 indicates a lower amount of muscle stretching. In some embodiments, updating the model is usable to help account for inexperience of the patient in determining a degree of muscle stretching. In some embodiments, updating the model is usable to help with calibrating the calculations in operation 125 for a specific user in order to help improve selection of feedback for muscle stretching in future PT sessions.

In some embodiments, the operation 140 is omitted. Omitting the operation 140 reduces a processing load on the system, e.g., system 600 (FIG. 6), used to implement the method 100. Maintaining the operation 140 helps to improve the relevance of the feedback provided for muscle stretching in operation 130.

One of ordinary skill in the art would understand that modifications to the method 100 are within the scope of this description. In some embodiments, additional operations are included in the method 100. For example, in some embodiments, data is provided to the patient regarding a progress of the patient over multiple PT sessions. In some embodiments, at least one operation is omitted from the method 100. For example, in some embodiments, the operation 140 is omitted. In some embodiments, an order of operations of the method 100 is adjusted. For example, in some embodiments, the operation 125 is performed prior to the operation 115.

Using the method 100 provides a patient is improved feedback for improving the exercise performed by the patient in comparison with other approaches by including not only analysis and feedback associated with pose information, but also with muscle stretch information. Analysis of the muscle stretch information helps the patient increase the benefit of the PT, in comparison with other approaches that rely solely on pose information.

Figure 2:
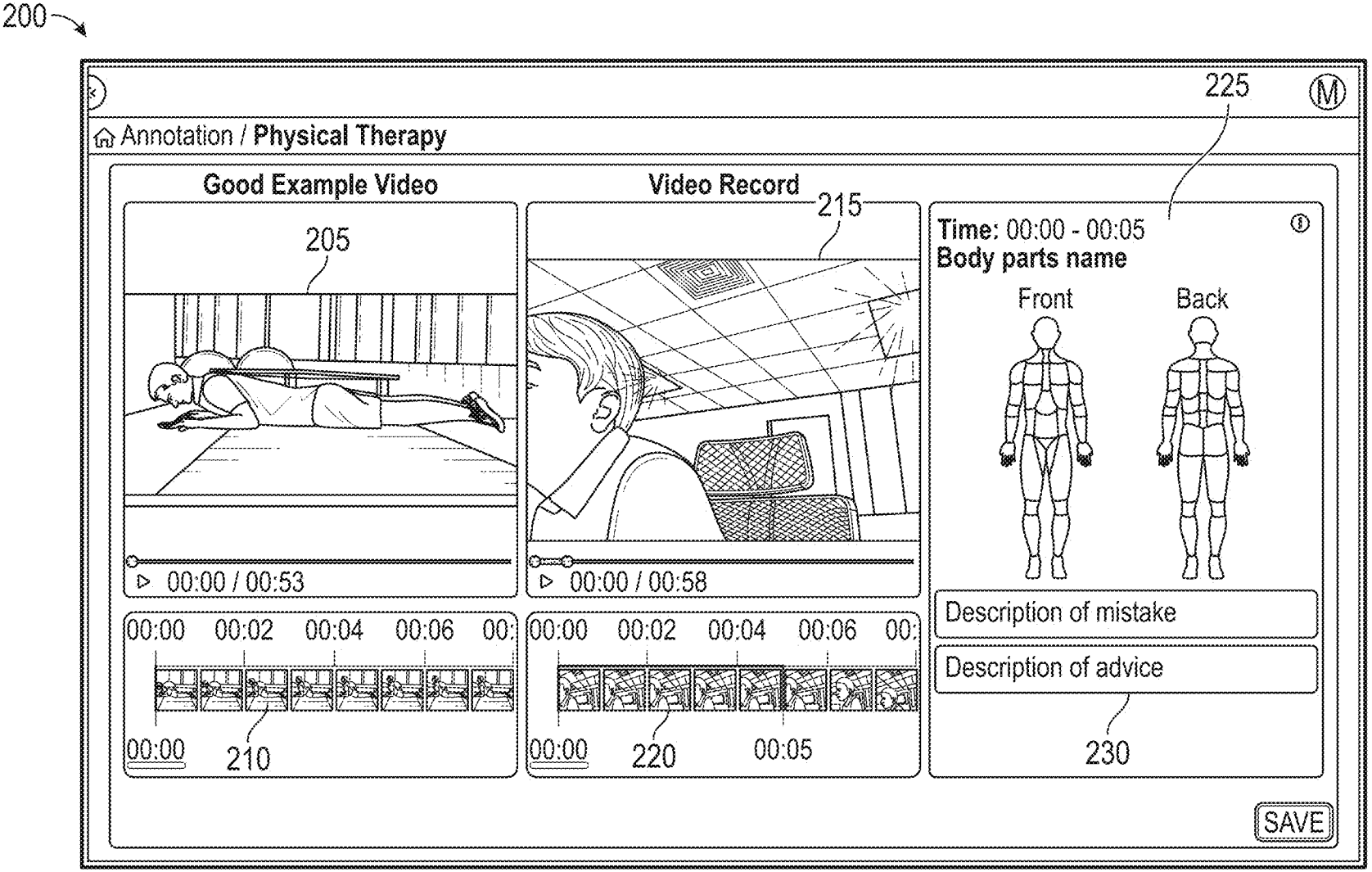
FIG. 2 is a view of a user interface (UI) for a system for providing exercise coaching, in accordance with some embodiments.

FIG. 2 is a view of a user interface (UI) 200 for a system for providing exercise coaching, in accordance with some embodiments. The UI 200 is usable to view a reference video, record a patient exercise video and provide feedback between the patient and the system or a trainer. In some embodiments, the UI 200 is implemented using the system 600 (FIG. 6). In some embodiments, the UI 200 is implemented by a system other than the system 600 (FIG. 6). One of ordinary skill in the art would recognize that the following description of the UI 200 is capable of modification within the scope of this application.

The UI 200 includes a reference video 205. The reference video 205 includes a video of a trainer or another patient performing the exercise in a proper manner. In some embodiments, the reference video 205 includes an animated video instead of a trainer or patient. The UI 200 further includes a plurality of reference images 210, which allow scrolling to different portions of the reference video 205. In some embodiments, the reference video 205 or reference images 210 are usable in the method 100 implementing at least the operation 115 or the operation 120 (FIG. 1).

The UI 200 further includes a patient video 215. The patient video 215 is a video of the patient performing the exercise. In some embodiments, a face or other personal identifying portions of the patient video 215 is automatically obscured during recording to protect the privacy of the patient. The patient video 215 is usable by the method 100 to calculate pose information or muscle stretch information. The UI 200 further includes a plurality of patient images 220. The plurality of patient images 220 are usable to provide still images for analysis and comparison with the reference images 210 during analysis of the exercise performed by the patient.

The UI 200 further includes a feedback panel 225. The feedback panel 225 is usable to display feedback to the patient for improving either the pose of the patient or the muscle stretch of the patient, e.g., using the method 100 (FIG. 1). The feedback panel 225 includes a display of a human form with outlines of various muscles. The display of the human form is usable to assist the patient in visualizing the different portions of the body being discussed as part of the feedback in order to assist the patient in improving pose or muscle stretching during the exercise.

The UI 200 further includes feedback descriptions 230. The feedback descriptions 230 include text that describes a type of mistake made by the patient during the exercise and recommendations for correcting the mistake. The UI 200 includes the feedback descriptions 230 as text boxes. In some embodiments, the feedback descriptions 230 include an audio file. In some embodiments, the feedback descriptions 230 include both an audio file and text boxes. In some embodiments, the UI 200 includes the feedback panel 225 highlighting a muscle discussed in the feedback descriptions 230.

In some embodiments, the UI 200 further includes a field for receiving an input from the patient. In some embodiments, the input includes information such as muscle stretch information, feedback from the patient regarding corrections provided by the trainer or system, or other suitable inputs. In some embodiments, the UI 200 includes a button or other item to allow a user to record a voice message as part of the input from the patient.

Using the UI 200 provides the patient with both a reference video 205 to attempt to emulate during the exercise as well as feedback pane 225 and feedback descriptions 230 to describe to the patient how to improve the performance of the exercise. Using the UI 200 as part of a method, e.g., the method 100 (FIG. 1), that provides feedback for both pose and muscle stretching helps to improve the effectiveness of the corrections to the patient. The improvement in correction effectiveness helps to increase a usefulness of the PT for the patient.

FIG. 3 is a schematic diagram of a system 300 for providing exercise coaching, in accordance with some embodiments. The system 300 provides exercise coaching to a person doing an exercise, also called a patient. In some embodiments, the system 300 is executed as a part of or in conjunction with a system 600 (FIG. 6). In some embodiments, the system 300 is executed independent of the system 600 (FIG. 6). In some embodiments, the system 300 is executed using a user interface (UI), such as UI 200 (FIG. 2) or another suitable UI. In some embodiments, the system 300 implements a method 100 (FIG. 1). In some embodiments, the system 300 is implemented using a trained NN, e.g., using the method 400 (FIG. 4). In some embodiments, the system 300 is implemented using selection of feedback using a solution space, e.g., solution space 500 (FIG. 5). One of ordinary skill in the art would recognize that the following description of the system 300 is capable of modification within the scope of this application.

The system 300 receives an exercise video as an input and determines pose information using a pose processing module 305. In some embodiments, the pose processing module 305 determines pose information similar to the operation 110 (FIG. 1).

The system 300 further determines, using a modality selector 310, whether to provide pose feedback or muscle stretch feedback based on the pose information from the pose processing module 305. In some embodiments, the modality selector 310 determines which type of feedback to provide based on whether a difference between the pose information and reference information is less than a predetermined threshold. In some embodiments, the modality selector determines which type of feedback to provide in a manner similar to the operation 115 (FIG. 1). In response to a determination to provide pose feedback, the system 300 proceeds to generating feedback using the feedback generator. In response to a determination to provide muscle stretch feedback, the system 300 proceeds to determine muscle stretch information using a muscle processing module 320.

The muscle processing module 320 includes a muscle stretch prediction module 322. The muscle stretch prediction module 322 includes a trained NN for predicting an amount of muscle stretch of the patient based on the exercise video. In some embodiments, the muscle stretch prediction module 322 uses the exercise video along with other data, such as additional images, additional videos, sensor data, patient input, or other suitable data. The muscle processing module 320 further includes a best pose selector 324 configured to select a recommendation to feedback to the patient based on the output of the muscle processing module 320.

The muscle stretch prediction module 322 includes the trained NN configured to receive the exercise video as well as some additional data, in some embodiments, and output a degree to which each monitored muscle of the patient was stretched during the exercise. The monitored muscles include muscles such as glute, calf, adductor, etc. In some embodiments, the degree of stretch is measured on a scale of 0 to 5, with 0 being no stretch and 5 being a maximum stretch. For example, in some embodiments, the muscle stretch prediction module 322 outputs a solution such as {(glute, 4), (calf, 0), (adductor, 1)}. One of ordinary skill in the art would recognize that this output format is merely exemplary and that other output formats are within the scope of this description.

The NN of the muscle stretch prediction module 322 is trained using training videos. The training videos include multiple samples of each of the exercises supported by the system 300. In some embodiments, the training videos include videos captured by a trainer during a PT session. The training videos are accompanied by annotations indicating feedback for improving the muscle stretch for each of the training videos. An example of an input for the training video includes (clamshell_1.mp4, {(glute, 1), (calf, 0), (adductor, 5)}<lean the left side of the body forward by 10 degrees>. In this sample input, the "clamshell" indicates the type of exercise being performed; the "mp4" indicates a format of the video file; the data within the curled brackets "{ }" indicates a stretch of the monitored muscles; and the information within the arrows "< >" indicates the feedback for improving the muscle stretch. One of ordinary skill in the art would recognize that the above example is not limiting and that different input formats are within the scope of this description. The degree of muscle stretch for the training inputs is determined by a trainer during an initial training of the NN. In addition, the feedback is determined by the trainer during the initial training of the NN. In some embodiments, once the NN is initially trained, the NN is able to receive input from the patient or trainer to further train or re-train the NN, such as using the operation 140 (FIG. 1). In some embodiments, the training of the NN is performed using multi label regression, sum of mean square error loss, or other suitable machine learning algorithms.

Using the trained NN, the muscle stretch prediction module 322 is able to receive the exercise video, along with additional data in some embodiments, and determine which muscles of the patient are being stretched and to what degree based on comparisons between the exercise video and data collected from the training videos used to train the NN. In some embodiments, the muscle stretch prediction module 322 extracts data directly from the exercise video, e.g., using a three-dimensional convoluted NN (3DCNN) or a CNN in combination with long short-term memory (LSTM), for each exercise performed by the patient. The muscle stretch prediction module 322 collects both skeletal data, which indicates how the parts of the body of the patient move during the exercise, as well as data indicating muscle flexing or movement. Based on the collected data, the muscle stretch prediction module 322 is able to estimate an amount of stretch for each monitored muscle of the patient.

The best pose selector 324 is configured to receive the output of the muscle stretch prediction module 322 and determine feedback to provide to the patient. In some embodiments, the best pose selector 324 is configured to provide the feedback as text, as audio, as video, or in another suitable format. In some embodiments, the best pose selector 324 is configured to consider patient information, such as age, experience, etc., in determining the feedback to the patient. For example, in some embodiments where the patient is older or new to PT, the best pose selector 324 does not select feedback intended to maximize the stretch of the muscle. Instead, the best pose selector 324 is able to select feedback for providing moderate improvements for muscle stretch to the patient until the patient reaches a performance that is consistent with the current health condition of the patient. In some embodiments, the best pose selector 324 utilizes a solution space, such as solution space 500 (FIG. 5), as a tool for selecting feedback to the patient.

The system 300 further includes a feedback generator 330 configured to receive the output of the best pose selector 324 and/or the output of the modality selector 310. The feedback generator 330 is configured to process and transmit feedback to the patient for improving either a pose or a muscle stretch associated with the exercise. In some embodiments, the feedback generator 330 is configured to output the feedback to a device, such as a smartphone, tablet, or computer, accessible by the patient. In some embodiments, the feedback generator 330 provides the feedback to a trainer for verification prior to transmitting the feedback to the patient, once verification is received.

One of ordinary skill in the art would recognize that modification to the system 300 is within the scope of this description. One of ordinary skill in the art would further understand that the various components of the system 300 are implemented using one or more processors.

Using the system 300 provides a patient with improved feedback for improving the exercise performed by the patient in comparison with other approaches by including not only analysis and feedback associated with pose information, but also with muscle stretch information. Analysis of the muscle stretch information helps the patient increase the benefit of the PT, in comparison with other approaches that rely solely on pose information.

FIG. 4 is a flowchart of a method 400 for muscle stretch prediction for determining muscle stretch information, in accordance with some embodiments. The method 400 is usable to provide exercise coaching to a person doing an exercise, also called a patient. In some embodiments, the method 400 is a method of implementing functionality of the muscle stretch prediction module 322 (FIG. 3). In some embodiments, the method 400 is executed as a part of or in conjunction with a system 300 (FIG. 3) or a system 600 (FIG. 6). In some embodiments, the method 400 is executed independent of the system 300 (FIG. 3) and the system 600 (FIG. 6). In some embodiments, the method 400 is executed using a user interface (UI), such as UI 200 (FIG. 2) or another suitable UI. In some embodiments, the method 400 is implemented in conjunction with the method 100 (FIG. 1). In some embodiments, the method 400 is implemented independent from the method 100 (FIG. 1). In some embodiments, the method 400 is implemented using selection of feedback using a solution space, e.g., solution space 500 (FIG. 5). One of ordinary skill in the art would recognize that the following description of the method 400 is capable of modification within the scope of this application.

The method 400 includes receiving an exercise video 405. The exercise video includes images of a patient performing an exercise. In some embodiments, the exercise video 405 is accompanied by other data, such as additional images, additional videos, sensor data, patient input, or other suitable data.

In operation 410, three dimensional (3D) pose estimation and tracking is performed using the exercise video, along with other data in some embodiments. The pose estimation and tracking converts the exercise video, along with other data in some embodiments, into skeletal features of the body of the patient. In some embodiments, the conversion is performed by tracking extremities or joints of the body. In some embodiments, the exercise video includes images from multiple angles to assist with the estimation and tracking of portions of the body occluded when images from only a single viewing angle is used.

In operation 415, movements of the body are captured by tracking the extremities and/or joints of the body over a series of images captured at different times. In some embodiments, the operation 415 tracks movements of the patient's body through at least one complete cycle of the exercise. In some embodiments, the operation 415 tracks movement of the patient's body through multiple cycles of the exercise. The operation 415 is configured to generate pose information. In some embodiments, the operation 415 is executed in a similar manner as operation 110 (FIG. 1).

In operation 420, feature functions related to the tracked movement are generated. In some embodiments where operation 415 tracks movement through multiple cycles, an average of the pose information is utilized for later analysis. In some embodiments that track pose information through multiple cycles, a maximum amount of movement of the pose information is utilized for later analysis. In some embodiments that track pose information through multiple cycles, a minimum amount of movement of the pose information is utilized for later analysis. One of ordinary skill in the art would recognize that other criteria, such as standard deviation, are also usable for analyzing pose information across multiple cycles. The operation 420 is configured to output skeletal features of the exercise video 405.

In operation 425 a NN is used to extract muscle stretch data from the exercise video, along with additional data in some embodiments. A trained NN is used to predict muscle stretch information based on the exercise video 405, along with additional data in some embodiments. In some embodiments, the NN is a 3DCNN. The operation 425 is configured to output muscle features of the exercise video 405.

In operation 430, the muscle features and the skeletal features are aggregated. Relationships between the muscle features and skeletal features are identified. In some embodiments, a trained NN is used to determine an impact of the skeletal features on the muscle features. In some embodiments, the operation 430 is implemented using a same NN as operation 425. In some embodiments, the feature aggregation includes a combination of the muscle features and the skeletal features. In some embodiments, the feature aggregation further includes concatenation, average pooling, or some other method of aggregating muscle features and skeletal features. The operation 430 outputs aggregated features.

In operation 435, the aggregated features are classified in order to generate muscle stretch information. The muscle stretch information indicates a degree of stretching for each of the monitored muscles. In some embodiments, the operation 435 is implemented using the same NN as the operation 425. In some embodiments, the operation 435 is integrated into the operation 425. In some embodiments, the muscle stretch information output from the operation 435 is similar to the output of the muscle stretch prediction module 322 (FIG. 3).

One of ordinary skill in the art would recognize that modification to the method 400 is within the scope of this description. In some embodiments, at least one additional operation is included in the method 400. For example, in some embodiments, the method 400 includes capturing additional data other than the exercise video 405. In some embodiments, at least one operation is omitted from the method 400. For example, in some embodiments, the operation 430 is integrated into the operation 425 and the operation 430 is omitted as a separate operation.

Using the method 400 provides a patient with improved feedback for improving the exercise performed by the patient in comparison with other approaches by including not only analysis and feedback associated with pose information, but also with muscle stretch information. Analysis of the muscle stretch information helps the patient increase the benefit of the PT, in comparison with other approaches that rely solely on pose information.

FIG. 5 is a view of a solution space 500 for providing exercise coaching recommendations, in accordance with some embodiments. The solution space 500 is usable to identify feedback to the patient to improve the movement of the patient for performing the exercise. In some embodiments, the solution space 500 is generated and analyzed by a system 300 (FIG. 3) or a system 600 (FIG. 6). In some embodiments, the solution space 500 is generated or analyzed independent of the system 300 (FIG. 3) and the system 600 (FIG. 6). In some embodiments, the solution space 500 is usable to generate feedback to the patient provided as part of a user interface (UI), such as UI 200 (FIG. 2) or another suitable UI. In some embodiments, the solution space 500 is used by the method 100 (FIG. 1) or the method 400 (FIG. 4) to generate feedback for the patient. In some embodiments, the solution space 500 is used by a method other than the method 100 (FIG. 1) or the method 400 (FIG. 4). One of ordinary skill in the art would recognize that the following description of the solution space 500 is capable of modification within the scope of this application.

The solution space 500 plots a performance 505 of an exercise by the patient. The location of the performance 505 in the solution space 500 is based on both muscle stretch information and skeletal information obtained by analyzing the exercise video of the patient. The solution space 500 is specific to the type of exercise being performed by the patient; and to a specific muscle monitored during the performance of the exercise. In the solution space 500, the muscle is labeled Xmuscle. A position of the performance 505 in the solution space 500 is based on muscle stretch information determined based on data collected during the performance of the exercise by the patient. In some embodiments, the data includes an exercise video, such as exercise video 405 (FIG. 4), or other data, as discussed above. The solution space 500 is generated using training data for a NN, such as during the implementation of the muscle stretch prediction module 322 (FIG. 3). In some embodiments, the solution space 500 is updated based on newly received data, such as by operation 140 (FIG. 1).

In addition to the performance 505, the solution space 500 also includes multiple feedback options, such as 510, 515 and 520. Only three feedback options are labeled for the sake of clarity of the drawing. The feedback options correspond to feedback which are able to be provided to the patient for improving the stretch of the muscle. In some embodiments, the feedback options correspond to a text or audio feedback. In some embodiments, the feedback options correspond to a video of a trainer or another patient performing the same exercise as the current patient.

Each feedback option, such as 510, 515 or 520, includes an initial stretch value 502*a* and a corrected stretch value 502*b*. The initial stretch value 502*a* indicates a degree of stretch for the muscle during a previous repetition of the exercise. The corrected stretch value 502*b* indicates a degree of stretch for the muscle following the feedback associated with the feedback option. For example, a prior patient performed the exercise and the NN determined that the muscle stretch had a degree of 3, which corresponds to the initial stretch value 502*a*. The prior patient was then given the feedback option and the prior patient performed the exercise again. Following the feedback the NN determined that the muscle stretch had a degree of 5, which corresponds to the correct value 502*b*.

The solution space 500 is usable to determine the degree of muscle stretch for the patient from a most recent repetition of the exercise and suggest feedback for the patient to reach a target degree of muscle stretch. The feedback option which is closest to the performance 505, which has a corrected stretch value closest to the target degree of muscle stretch is selected as the feedback to be provided to the patient. For example, if the patient had performance 505 indicating a degree of muscle stretch as 1 and the target muscle stretch is to maximize the degree of stretch of the muscle, then the solution space 500 is usable to identify the feedback option 510. The feedback option 510 includes an initial stretch value of 1, which matches the performance 505, and a corrected stretch value of 5, which is a maximum degree of muscle stretch. As a result, the solution space 500 is used to identify the feedback option 510, which is provided to the patient for improving in the next repetition of the exercise. In some instances, a target degree of muscle stretch is different from the maximum degree of muscle stretch for reasons discussed above. In such a situation, the solution space 500 is usable to select a feedback option which is closest to the target degree of muscle stretch. For example, if the patient is very new to PT and only a moderate increase in muscle stretch is desired then the solution space 500 is usable to select the feedback option 520 to provide to the patient. In another example, if the patient has an intermediate level of experience with PT and a greater degree of muscle stretch, but less than the maximum, is sought, then the solution space 500 is usable to select the feedback option 515.

One of ordinary skill in the art would understand that modifications to the solution space 500 is within the scope of this description. For example, in some embodiments, the solution space 500 is adjusted to account for the degree of stretching of multiple muscles during a single exercise.

Using the solution space 500 helps to improve the exercise coaching provided to the patient by identifying feedback that helped to improve patients with a similar level of performance reach the target degree of muscle stretch. As a result, the patient is able to receive feedback that is most relevant to the patient and is most likely to help the patient to progress during PT; and a frustration level of the patient is reduced in comparison with approaches that fail to provide customized feedback.

FIG. 6 is a diagram of a system 600 for exercise coaching, in accordance with some embodiments. System 600 includes a hardware processor 602 and a non-transitory, computer readable storage medium 604 encoded with, i.e., storing, the computer program code 606, i.e., a set of executable instructions. Computer readable storage medium 604 is also encoded with instructions 607 for interfacing with external devices. The processor 602 is electrically coupled to the computer readable storage medium 604 via a bus 608. The processor 602 is also electrically coupled to an input/output (I/O) interface 610 by bus 608. A network interface 612 is also electrically connected to the processor 602 via bus 608. Network interface 612 is connected to a network 614, so that processor 602 and computer readable storage medium 604 are capable of connecting to external elements via network 614. The processor 602 is configured to execute the computer program code 606 encoded in the computer readable storage medium 604 in order to cause system 600 to be usable for performing a portion or all of the operations as described in method 100 (FIG. 1), to implement UI 200 (FIG. 2), system 300 (FIG. 3), method 400 (FIG. 4), or use solution space 500 (FIG. 5).

In some embodiments, the processor 602 is a central processing unit (CPU), a multi-processor, a distributed processing system, an application specific integrated circuit (ASIC), and/or a suitable processing unit.

In some embodiments, the computer readable storage medium 604 is an electronic, magnetic, optical, electromagnetic, infrared, and/or a semiconductor system (or apparatus or device). For example, the computer readable storage medium 604 includes a semiconductor or solid-state memory, a magnetic tape, a removable computer diskette, a random access memory (RAM), a read-only memory (ROM), a rigid magnetic disk, and/or an optical disk. In some embodiments using optical disks, the computer readable storage medium 604 includes a compact disk-read only memory (CD-ROM), a compact disk-read/write (CD-R/W), and/or a digital video disc (DVD).

In some embodiments, the storage medium 604 stores the computer program code 606 configured to cause system 600 to perform method 300 or method 400. In some embodiments, the storage medium 604 also stores information used for performing a portion or all of the operations as described in method 100 (FIG. 1), to implement UI 200 (FIG. 2), system 300 (FIG. 3), method 400 (FIG. 4), or use solution space 500 (FIG. 5); as well as information generated during performing a portion or all of the operations as described in method 100 (FIG. 1), to implement UI 200 (FIG. 2), system 300 (FIG. 3), method 400 (FIG. 4), or use solution space 500 (FIG. 5), such as a pose data parameter 616, a pose threshold parameter 618, a muscle stretch data parameter 620, a muscle stretch NN parameter 622, a solution space parameter 624 and/or a set of executable instructions to perform the operation of a portion or all of the operations as described in method 100 (FIG. 1), to implement UI 200 (FIG. 2), system 300 (FIG. 3), method 400 (FIG. 4), or use solution space 500 (FIG. 5).

In some embodiments, the storage medium 604 stores instructions 607 for interfacing with external devices. The instructions 607 enable processor 602 to generate manufacturing instructions readable by the external devices to effectively implement a portion or all of the operations as described in method 100 (FIG. 1), to implement UI 200 (FIG. 2), system 300 (FIG. 3), method 400 (FIG. 4), or use solution space 500 (FIG. 5).

System 600 includes I/O interface 610. I/O interface 610 is coupled to external circuitry. In some embodiments, I/O interface 610 includes a touchscreen, a keyboard, keypad, mouse, trackball, trackpad, and/or cursor direction keys for communicating information and commands to processor 602.

System 600 also includes network interface 612 coupled to the processor 602. Network interface 612 allows system 600 to communicate with network 614, to which one or more other computer systems are connected. Network interface 612 includes wireless network interfaces such as BLUETOOTH, WIFI, WIMAX, GPRS, or WCDMA; or wired network interface such as ETHERNET, USB, or IEEE-1394. In some embodiments, a portion or all of the operations as described in method 100 (FIG. 1), to implement UI 200 (FIG. 2), system 300 (FIG. 3), method 400 (FIG. 4), or use solution space 500 (FIG. 5) is implemented in two or more systems 600, and information such as pose data, pose threshold, muscle stretch data, muscle stretch NN, or solution space, are exchanged between different systems 600 via network 614.

Supplemental Note 1

An aspect of this description relates to a system for providing exercise coaching. The system includes a non-transitory computer readable medium configured to store instructions thereon. The system further includes a processor connected to the non-transitory computer readable medium. The processor is configured to execute the instructions for receiving input data from a user, wherein the input data comprises a plurality of images of the user performing an exercise. The processor is configured to execute the instructions for extracting pose data from the input data. The processor is configured to execute the instructions for determining whether a difference between the extract pose data and a reference is less than a predetermined threshold value. The processor is configured to execute the instructions for determining muscle stretch information, in response to the difference being less than the predetermined threshold value, from the input data. The processor is configured to execute the instructions for determining feedback to provide to the user for increasing a degree of muscle stretch during a subsequent performance of the exercise relative to the determined muscle stretch information.

Supplemental Note 2

The system according to Supplemental Note 1, wherein the processor is further configured to execute the instructions for determining feedback to provide to the user for correcting a pose of the user in the subsequent performance of the exercise in response to the difference being equal to or greater than the predetermined threshold value.

Supplemental Note 3

The system according to Supplemental Note 1 or Supplemental Note 2, wherein the processor is further configured to execute the instructions for determining the muscle stretch information using a trained neural network (NN), and the trained NN is trained using videos of others performing the exercise.

Supplemental Note 4

The system according to any of Supplemental Note 1-3, wherein the processor is further configured to execute the instructions for updating the trained NN using the muscle stretch information.

Supplemental Note 5

The system according to any of Supplemental Note 1-4, wherein the processor is further configured to execute the instructions for determining the feedback using the trained NN to select a feedback option from a solution space.

Supplemental Note 6

The system according to any of Supplemental Note 1-5, wherein the processor is configured to execute the instructions for selecting the feedback option from the solution space based on an initial muscle stretch value and a target muscle stretch value, the initial muscle stretch value is determined based on the muscle stretch information, and the target muscle stretch value is determined based on user information of the user performing the exercise, and the feedback is usable to improve decision making for the user for moving at least one body part of the user.

Supplemental Note 7

The system according to any of Supplemental Note 1-6, wherein the predetermined threshold value is based on user information of the user performing the exercise.

Supplemental Note 8

An aspect of this description relates to a method of providing exercise coaching. The method includes receiving input data from a user, wherein the input data comprises a plurality of images of the user performing an exercise. The method includes extracting pose data from the input data. The method includes determining whether a difference between the extract pose data and a reference is less than a predetermined threshold value. The method includes determining muscle stretch information, in response to the difference being less than the predetermined threshold value, from the input data. The method includes determining feedback to provide to the user for increasing a degree of muscle stretch during a subsequent performance of the exercise relative to the determined muscle stretch information.

Supplemental Note 9

The method according to Supplemental Note 8, further comprising determining feedback to provide to the user for correcting a pose of the user in the subsequent performance of the exercise in response to the difference being equal to or greater than the predetermined threshold value.

Supplemental Note 10

The method according to Supplemental Note 8 or Supplemental Note 9, wherein the muscle stretch information is determined using a trained neural network (NN), and the trained NN is trained using videos of others performing the exercise.

Supplemental Note 11

The method according to any of Supplemental Note 8-10, further comprising updating the trained NN using the muscle stretch information.

Supplemental Note 12

The method according to any of Supplemental Note 8-11, wherein the feedback is determined using the trained NN to select a feedback option from a solution space.

Supplemental Note 13

The method according to any of Supplemental Note 8-12, wherein selecting the feedback option from the solution space is based on an initial muscle stretch value and a target muscle stretch value, the initial muscle stretch value is determined based on the muscle stretch information, and the target muscle stretch value is determined based on user information of the user performing the exercise, and the feedback is usable to improve decision making for the user for moving at least one body part of the user.

Supplemental Note 14

The method according to any of Supplemental Note 8-13, wherein the predetermined threshold value is based on user information of the user performing the exercise.

Supplemental Note 15

An aspect of this description relates to a non-transitory computer readable medium configured to store instructions for providing exercise coaching. The instructions are configured to cause a processor to perform operations comprising receiving input data from a user, wherein the input data comprises a plurality of images of the user performing an exercise. The instructions are configured to cause a processor to perform operations comprising extracting pose data from the input data. The instructions are configured to cause a processor to perform operations comprising determining whether a difference between the extract pose data and a reference is less than a predetermined threshold value. The instructions are configured to cause a processor to perform operations comprising determining muscle stretch information, in response to the difference being less than the predetermined threshold value, from the input data. The instructions are configured to cause a processor to perform operations comprising determining feedback to provide to the user for increasing a degree of muscle stretch during a subsequent performance of the exercise relative to the determined muscle stretch information.

Supplemental Note 16

The non-transitory computer readable medium according to Supplemental Note 15, wherein the instructions are further configured to cause the processor to perform operations comprising determining feedback to provide to the user for correcting a pose of the user in the subsequent performance of the exercise in response to the difference being equal to or greater than the predetermined threshold value.

Supplemental Note 17

The non-transitory computer readable medium according to Supplemental Note 15 or Supplemental Note 16, wherein the instructions are further configured to cause the processor to perform operations comprising determining the muscle stretch information using a trained neural network (NN), and the trained NN is trained using videos of others performing the exercise.

Supplemental Note 18

The non-transitory computer readable medium according to any of Supplemental Note 15-17, wherein the instructions are further configured to cause the processor to perform operations comprising updating the trained NN using the muscle stretch information.

Supplemental Note 19

The non-transitory computer readable medium according to any of Supplemental Note 15-18, wherein the instructions are further configured to cause the processor to perform operations comprising determining the feedback is determined using the trained NN to select a feedback option from a solution space, and selecting the feedback option from the solution space is based on an initial muscle stretch value and a target muscle stretch value, the initial muscle stretch value is determined based on the muscle stretch information, and the target muscle stretch value is determined based on user information of the user performing the exercise, and the feedback is usable to improve decision making for the user for moving at least one body part of the user.

Supplemental Note 20

The non-transitory computer readable medium according to any of Supplemental Note 15-19, wherein the predetermined threshold value is based on user information of the user performing the exercise.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A system for providing exercise coaching comprises:

a non-transitory computer readable medium configured to store instructions thereon; and a processor connected to the non-transitory computer readable medium, wherein the processor is configured to execute the instructions for:

receiving input data from a user, wherein the input data comprises a plurality of images of the user performing an exercise;

extracting pose data from the input data;

determining whether a difference between the extracted pose data and a reference is less than a predetermined threshold value, wherein the predetermined threshold value is determined based on experience of physical therapy of the user;

determining muscle stretch information, in response to the difference being less than the predetermined threshold value, from the input data, wherein determining the muscle stretch information comprises using a trained neural network, wherein the trained neural network extracts data from the input data using a three-dimensional convolutional neural network to determine changes in shape of a body of the user as body parts of the user move during the exercise based on skeletal data indicating how parts of the body of the user move during the exercise and data indicating muscle flexing or movement; and determining feedback to provide to the user for increasing a degree of muscle stretch during a subsequent performance of the exercise relative to the determined muscle stretch information.

2. The system according to claim 1, wherein the processor is further configured to execute the instructions for determining feedback to provide to the user for correcting a pose of the user in the subsequent performance of the exercise in response to the difference being equal to or greater than the predetermined threshold value.

3. The system according to claim 1, wherein the trained neural network NN is trained using videos of others performing the exercise.

4. The system according to claim 3, wherein the processor is further configured to execute the instructions for updating the trained NN using the muscle stretch information.

5. The system according to claim 3, wherein the processor is further configured to execute the instructions for determining the feedback using the trained NN to select a feedback option from a solution space.

6. The system according to claim 5, wherein the processor is configured to execute the instructions for selecting the feedback option from the solution space based on an initial muscle stretch value and a target muscle stretch value, the initial muscle stretch value is determined based on the muscle stretch information, and the target muscle stretch value is determined based on user information of the user performing the exercise, and the feedback is usable to improve decision making for the user for moving at least one body part of the user.

7. The system according to claim 1, wherein the input data is received from a structure light sensor camera configured to capture the plurality of images of the user performing the exercise.

8. A method of providing exercise coaching comprises:

receiving input data from a user, wherein the input data comprises a plurality of images of the user performing an exercise;

extracting pose data from the input data;

determining whether a difference between the extracted pose data and a reference is less than a predetermined threshold value, wherein the predetermined threshold value is determined based on experience of physical therapy of the user;

determining muscle stretch information, in response to the difference being less than the predetermined threshold value, from the input data, wherein determining the muscle stretch information comprises using a trained neural network, wherein the trained neural network extracts data from the input data using a three-dimensional convolutional neural network to determine changes in shape of a body of the user as body parts of the user move during the exercise based on skeletal data indicating how parts of the body of the user move during the exercise and data indicating muscle flexing or movement; and determining feedback to provide to the user for increasing a degree of muscle stretch during a subsequent performance of the exercise relative to the determined muscle stretch information.

9. The method according to claim 8, further comprising determining feedback to provide to the user for correcting a pose of the user in the subsequent performance of the exercise in response to the difference being equal to or greater than the predetermined threshold value.

10. The method according to claim 8, wherein the trained neural network NN is trained using videos of others performing the exercise.

11. The method according to claim 10, further comprising updating the trained NN using the muscle stretch information.

12. The method according to claim 10, wherein the feedback is determined using the trained NN to select a feedback option from a solution space.

13. The method according to claim 10, wherein selecting the feedback option from the solution space is based on an initial muscle stretch value and a target muscle stretch value, the initial muscle stretch value is determined based on the muscle stretch information, and the target muscle stretch value is determined based on user information of the user performing the exercise, and the feedback is usable to improve decision making for the user for moving at least one body part of the user.

14. The method according to claim 8, wherein the input data is received from a structure light sensor camera configured to capture the plurality of images of the user performing the exercise.

15. A non-transitory computer readable medium configured to store instructions for providing exercise coaching, wherein the instructions are configured to cause a processor to perform operations comprising:

receiving input data from a user, wherein the input data comprises a plurality of images of the user performing an exercise;

extracting pose data from the input data;

determining whether a difference between the extracted pose data and a reference is less than a predetermined threshold value, wherein the predetermined threshold value is determined based on experience of physical therapy of the user;

determining muscle stretch information, in response to the difference being less than the predetermined threshold value, from the input data, wherein determining the muscle stretch information comprises using a trained neural network, wherein the trained neural network extracts data from the input data using a three-dimensional convolutional neural network to determine changes in shape of a body of the user as body parts of the user move during the exercise based on skeletal data indicating how parts of the body of the user move during the exercise and data indicating muscle flexing or movement; and determining feedback to provide to the user for increasing a degree of muscle stretch during a subsequent performance of the exercise relative to the determined muscle stretch information.

16. The non-transitory computer readable medium according to claim 15, wherein the instructions are further configured to cause the processor to perform operations comprising determining feedback to provide to the user for correcting a pose of the user in the subsequent performance of the exercise in response to the difference being equal to or greater than the predetermined threshold value.

17. The non-transitory computer readable medium according to claim 15, wherein the trained neural network NN is trained using videos of others performing the exercise.

18. The non-transitory computer readable medium according to claim 17, wherein the instructions are further configured to cause the processor to perform operations comprising updating the trained NN using the muscle stretch information.

19. The non-transitory computer readable medium according to claim 17, wherein the instructions are further configured to cause the processor to perform operations comprising determining the feedback using the trained NN to select a feedback option from a solution space, and selecting the feedback option from the solution space based on an initial muscle stretch value and a target muscle stretch value, the initial muscle stretch value is determined based on the muscle stretch information, and the target muscle stretch value is determined based on user information of the user performing the exercise, and the feedback is usable to improve decision making for the user for moving at least one body part of the user.

20. The non-transitory computer readable medium according to claim 15, wherein the input data is received from a structure light sensor camera configured to capture the plurality of images of the user performing the exercise.

* * * * *